United States Patent [19]

Brown

[11] 4,263,950

[45] Apr. 28, 1981

[54] GOLF BAG TOP INSERT

[76] Inventor: William L. Brown, P.O. Box 541, 1739 Middle St., Sullivan's Island, S.C. 29482

[21] Appl. No.: 88,182

[22] Filed: Oct. 25, 1979

[51] Int. Cl.[3] ..... A63B 55/00

[52] U.S. Cl. ..... 150/1.5 R

[58] Field of Search ..... 150/1.5 R, 1.5 B, 1.5 C

[56] References Cited

U.S. PATENT DOCUMENTS

| | | | |
|---|---|---|---|
| 1,746,857 | 2/1930 | Hotze | 150/1.5 R |
| 2,607,382 | 8/1952 | LeVine | 150/1.5 R |
| 3,674,072 | 7/1972 | Shuto | 150/1.5 R |
| 3,996,983 | 12/1976 | Isnardi | 150/1.5 R |

*Primary Examiner*—Donald F. Norton

*Attorney, Agent, or Firm*—Larry Harold Kline

[57] ABSTRACT

A device is disclosed for insertion into the top of a golf bag comprising a longitudinally-tapered body with an insert top in the shape of the perimeter of the top of the bag, with a stop rigidly secured to the insert top and a gripping device operative to aid movement.

16 Claims, 17 Drawing Figures

GOLF BAG TOP INSERT

This invention relates to golf bag construction and more particularly to a golf bag which can be altered in configuration to be used in a variety of situations.

There are many designs of golf bags. The present invention provides for a golf bag which may be designed or constructed by the golfer to meet the need or desire of the moment. Presently, golf bags do not have the adaptability to be varied in configuration to the desire of the user. The present invention provides a universal golf bag which can be varied to the desire and need of the golfer.

An object of the present invention is to provide a golf bag which can be altered in its arrangement or configuration without special tools or devices.

Another object of the present invention is to provide a golf bag which is adaptable for use with a variety of conveniently located pockets.

Still another object of this invention is to provide a golf bag with detachable pockets.

A further object of this invention is to provide a golf bag with a detachable apron and detachable pockets.

Another objects of this invention is to provide a golf bag with a rotatable, removable top insert.

Another objects of this invention is to provide a golf bag on which the pockets can be removed or added and the top insert rotated for convenient use on a powered cart.

Still another object of this invention is to provide a golf bag on which the pocket can be removed or added and the top insert rotated for convenient use on a pull cart.

Still another object of this invention is to provide a golf bag with all pockets secured to the bag in a manner in which when the bag is attached to a cart, that all pockets will be accessible.

These and other objects and features of the invention will be apparent from the following description and appended claims.

Briefly, the invention is a bag for transporting golf equipment comprising a longitudinal structure which is operative to hold the golf equipment. A fastening area on the outside surface of the longitudinal structure is operative for the securing of pockets. A mounting area on the outside surface of the longitudinal structure is not operative for the securing of pockets. Bag fastening means is rigidly secured to the fastening area of the longitudinal structure. The fastening means comprises a plurality of fasteners vertically and horizontally aligned in a plurality of rows. A plurality of pockets may be removably secured to the fastening area utilizing the bag fastening means. A bag top insert may be placed in the top of the bag and is operative to be removable and rotatable. The longitudinal structure may be cylindrical in shape. The fastening area may cover approximately half the circumference of the longitudinal structure. The mounting area may cover approximately half the circumference of the longitudinal structure. Each pocket of the plurality of pockets may comprise pocket fastening means, which are operative to secure the pocket to the bag fastening means. An inner area within the pocket is operative to store various articles. Pocket entry means on the pocket is operative for entry to the inner area. The pocket may further comprise a sleeve on the outer surface of the pocket operative to secure equipment through the sleeve. The plurality of pockets may comprise pockets of different sizes. The pockets of different sizes may have pocket fastening means of different quantities in respect to the different size of the pockets of different sizes. The bag may have an apron the size of the fastening area removably secured to the fastening area utilizing the bag fastening means. Apron fastening means is operative to be secured to the bag fastening means to secure the apron to the bag. When utilizing the apron, the plurality of pockets is removeably secured to the apron utilizing the apron fastening means. When utilizing the apron, the pocket fastening means is operative to secure the pocket to the apron fastening means. The bag fastening means, the pocket fastening means, and the apron fastening means, each may comprise a plurality of snaps or may comprise a plurality of velcro strips or may comprise any other fastening means. The bag top insert comprises a device for insertion into the top of a bag for carrying golf equipment. The device comprises a longitudinally-tapered body with an insert top in the shape of the perimeter of the top of the bag and operative to fit into the top of the bag. A stop is rigidly secured to the insert top of the longitudinally-tapered body operative to rest on the top of the bag and to hold the tapered body securely. Gripping means is within the device operative to aid in movement. The device can be removed and rotated by use of the gripping means. The device may comprise a bar-separator comprising a member with two opposite ends secured in the longitudinally-tapered body. The bar-separator is operative to separate the golf equipment in the bag. An opening within the bar-separator is operative to be utilized as a gripping means. The insert top of the longitudinally-tapered body may be circular. The height of the insert top may be level across the device. The height of the insert top may be slanted across the device. The height of the insert top may be sloped across the device. The device may comprise a tube-opening sheet secured across the device at the bottom of the longitudinally-tapered body. A bar may be secured to the top of the tube-opening sheet with two opposite ends secured in the longitudinally tapered body. The bar may have an opening to be utilized as gripping means. A plurality of bars with openings may be utilized as gripping means. A plurality of bar-separators with openings may be utilized as gripping means. The tube-opening sheet may have a plurality of tube openings and utility openings through which golf equipment may be placed to be secured within the bag.

The invention will be more fully understood from the following detailed description and appended claims when taken with the drawings in which:

Figure 1:
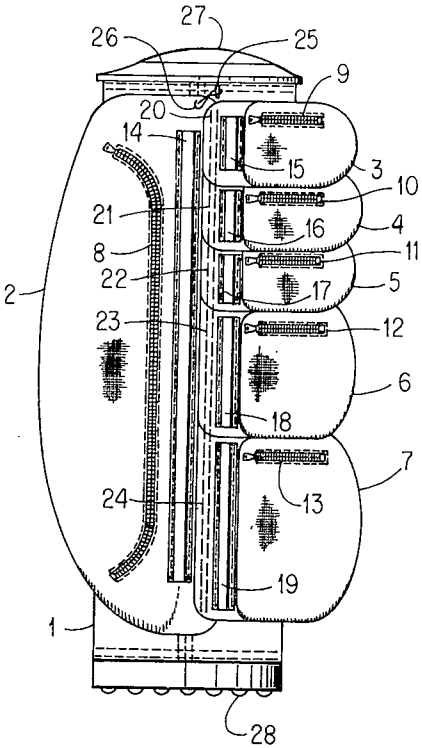
FIG. 1 is a front elevated view of a golf bag with pockets permanently secured.

Referring now the the drawings, FIG. 1 is a front elevated view of golf bag 1 with pockets permanently secured. Golf bag 1 has pocket 2, pocket 3, pocket 4, pocket 5, pocket 6, and pocket 7. Pocket 2 has zipper opening 8, pocket 3 has zipper opening 9, pocket 4 has zipper opening 10, pocket 5 has zipper opening 11, pocket 6 has zipper opening 12, pocket 7 has zipper opening 13. Pocket 2 has a sleeve 14, pocket 3 has a sleeve 15, pocket 4 has a sleeve 16, pocket 5 has a sleeve 17, pocket 6 has a sleeve 18, pocket 7 has a sleeve 19. The pockets 2,3,4,5,6, and 7 are secured on to the bag 1. Stitching 20 secures pocket 3 through pocket 2 onto bag 1. Stitching 21 secures pocket 4 through pocket 2 onto bag 1. Stitching 22 secures pocket 5 through pocket 2 onto bag 1. Stitching 23 secures pocket 6 through pocket 2 onto bag 1. Stitching 24 secures pocket 7 through pocket 2 onto bag 1. Pockets 2,3,4,5,6, and 7 have stitching (not shown) on the opposite side of the pocket from the stitching shown to further secure the pockets onto bag 1. A utility connector 25 may be connected to bag 1. A utility hook 26 may be secured onto utility connector 25. Bag 1 has a sloped top insert 27 and bottom rest 28.

Bag 1 is designed so that all of the pockets are easily accessible. If bag 1 were placed on a cart, the pockets would be placed so that they were easily convenient to the golfer.

Figure 2:
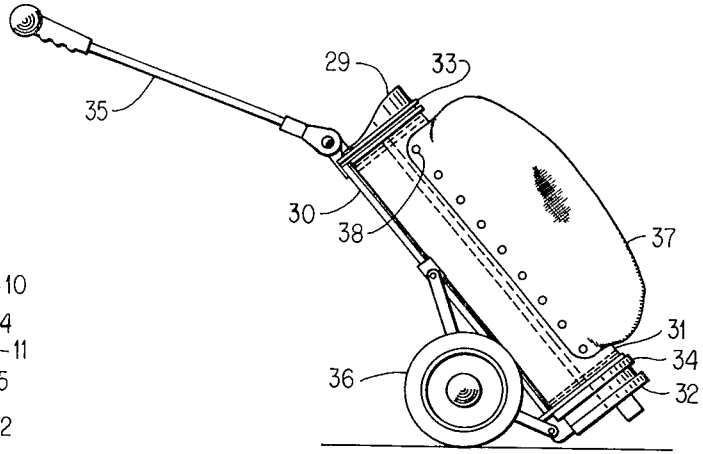
FIG. 2 is a side view of a golf bag on a hand cart showing a large pocket removably attached with the top insert positioned for use on a hand cart.

FIG. 2 is a side view of a golf bag 31 on a hand cart 30. The golf bag 31 has a large detachable pocket 37. Bag 31 has a sloped top insert 29 and other detachable pocket 37. Bag 31 has a sloped top insert 29 and other detachable pockets, which are conveniently located on the bag 31 but not shown in this view. Bag 31 rests in hand cart 30. Hand cart 30 has wheel 36 and another wheel (not shown), a handle 35, a base holder 32 and securing means 33 and 34. Shown on detachable pocket 37 is a series of securing snaps 38.

Figure 3:
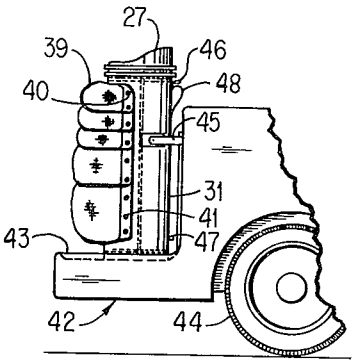
FIG. 3 is a side view of a golf bag on a powered cart with the top insert rotated for use on a powered cart.

FIG. 3 shows a side view of a golf bag 31 resting in a powered cart 42. Powered cart 42 has wheel 44 and other wheels (not shown). The bag 31 rests on bag rest 43 of powered cart 42. Bag 31 has a series of securing snaps 41 such as snap 40 on small detachable pocket 39. Bag 31 also may have a large detachable pocket 37 and a series of securing snaps 38 as shown in FIG. 2.

The powered cart 42 has securing means 45 securing bag 31 to powered cart 42. Bag 31 has utility connectors 46 and 47 for use with straps when the bag is carried or for any other desired purpose. Bag 31 has a bag handle 48. Sloped top insert 27 is shown on bag 31 in FIG. 3.

Figure 4:
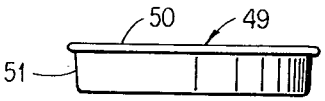
FIG. 4 is a side view of a straight top insert.

FIG. 4 is a side view of a straight top insert 49. Straight top insert 49 has a stop 50 and a tapered body 51. Stop 50 of straight top insert 49 allows the straight top insert 49 to be secured onto bag 31 with the tapered body 51 extending into the top of bag 31.

Figure 5:
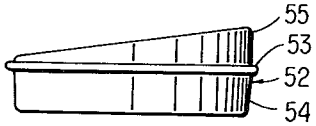
FIG. 5 is a side view of a slanted top insert.

FIG. 5 is a side view of a slanted top insert 52. Slanted top insert 52 has a stop 53 and a tapered body 54. Stop 53 of slanted top insert 52 rests on the top of bag 31 with tapered body 54 extending into bag 31. Slanted top insert 52 has a slanted top 55.

Figure 6:
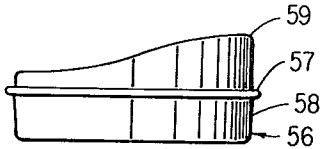
FIG. 6 is a side view of a sloped top insert.

FIG. 6 is a side view of a sloped top insert 56. Sloped top insert 56 has a stop 57 and a tapered body 58. Tapered body 58 extends into bag 31 with the stop 57 resting at the top of bag 31. Sloped top insert 56 has a sloped top 59.

Figure 7:
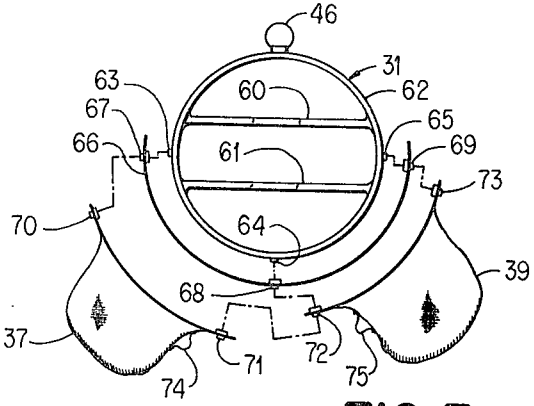
FIG. 7 is a top exploded view of a bag with a detachable apron and detachable pockets.

FIG. 7 is a top exploded view of bag 31 with a detachable apron 66 showing detachable pockets 37 and 39. Top insert 62 is shown on bag 31. Top insert 62 has bar-separators 60 and 61. Bar-separators 60 and 61 may be utilized to separate golf equipment which are placed into bag 31. Bag 31 has a series of male snaps such as top male snap 63. Bag 31 has another series of male snaps such as top male snap 64. Bag 31 has another series of male snaps such as top male snap 65. Apron 66 has a series of double snaps such as top double snap 67. Apron 66 has another series of double snaps such as top double snap 68. Apron 66 has another series of double snaps such as top double snap 69. Pocket 37 has a top left double snap 70. Top left double snap 70 is one of a series of left double snaps 38 on pocket 37. Pocket 37 has a top right double snap 71. Top right double snap 71 is one of a series of right double snaps 88 on pocket 37. Pocket 39 has a top left double snap 72. Top left double snap 72 is one of a series of left double snaps 89 on pocket 39. Pocket 39 has a top right double snap 73. Top right double snap 73 is one of a series of right double snaps 40 on pocket 39. Pocket 37 has a sleeve 74. Pocket 39 has a sleeve 75. Apron 66 is secured to bag 31. Pockets 37 and 39 are secured onto apron 66 which is secured to bag 31. To secure apron 66 onto bag 31, snap 67 is secured to snap 63, snap 68 is secured to snap 64, and snap 69 is secured to snap 65. To secure pocket 39 to apron 66, snap 73 is secured to snap 69 and snap 72 is secured to snap 68. To secure pocket 37 onto apron 66, snap 70 is secured to snap 67 and snap 71 is secured to snap 68. Snaps 71 or 72 may be secured directly to snap 68 if snap 72 is secured directly to snap 68 then snap 71 will be secured to snap 72. If snap 71 is secured to snap 68, the snap 72 will be secured to snap 71.

Figure 8:
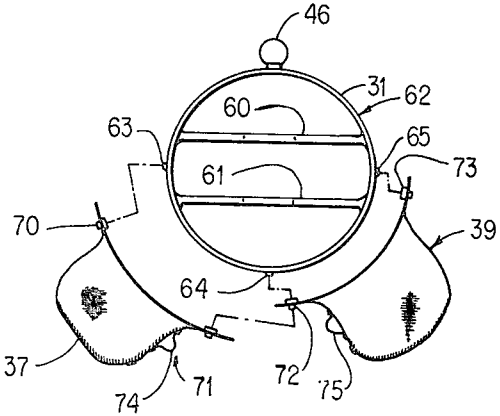
FIG. 8 is a top exploded view of a bag with detachable pockets without the detachable apron.

FIG. 8 is a top exploded view of bag 31 with detachable pockets 37 and 29 without utilizing apron 66. To secure pocket 37 to bag 31, snap 70 is secured to snap 63 and snap 71 is secured to snap 64. To secure pocket 39 to bag 31, snap 73 is secured to snap 65 and snap 72 is secured to snap 64. Either snap 71 or snap 72 may be secured to snap 64. If snap 71 is secured to snap 64, then snap 72 will be secured on to snap 71. If snap 72 is secured onto snap 64 then snap 71 will be secured onto snap 72.

Figure 9:
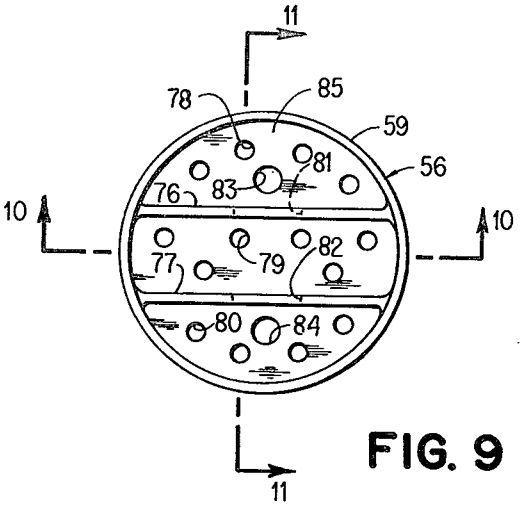
FIG. 9 is a top view of a sloped rotatable, removable insert with a sloped top and tube openings.

FIG. 9 is a top view of a sloped rotatable, removable insert 56.

Figure 10:
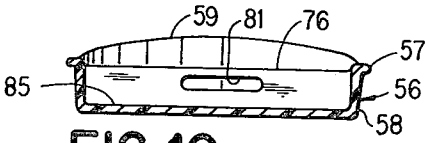
FIG. 10 is a sectional view taken at section 10—10 of FIG. 9.

FIG. 10 is a sectional view taken at section 10—10 of FIG. 9.

Figure 11:
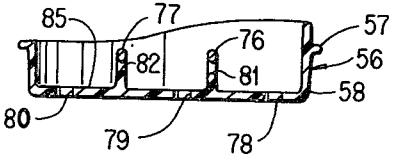
FIG. 11 is a sectional view taken at section 11—11 of FIG. 9.

FIG. 11 is a sectional view taken at section 11—11 of FIG. 9.

Sloped rotatable, removable insert 56 is shown in a side view in FIG. 6. Insert 56 has a stop 57, a tapered body 58 and a sloped top 59. Insert 56 is shown with a tube-opening sheet 85 comprising a series of tube openings 78, 79, and 80. Bar handles 76 and 77 separate the series of tube openings 78, 79 and 80. Bar Handle 76 separates series of tube openings 78 from series of tube openings 79. Bar Handle 77 separates series of tube openings 79 from tube openings 80. Bar handle 76 has an opening 81. Bar handle 77 has an opening 82. Openings 81 and 82 may be utilized for gripping purposes for the removal or rotating of insert 56. Tube-opening sheet 85 has utility openings 83 and 94 which may be utilized for any desired purpose, such as, umbrella storage or extra club storage.

Figure 12:
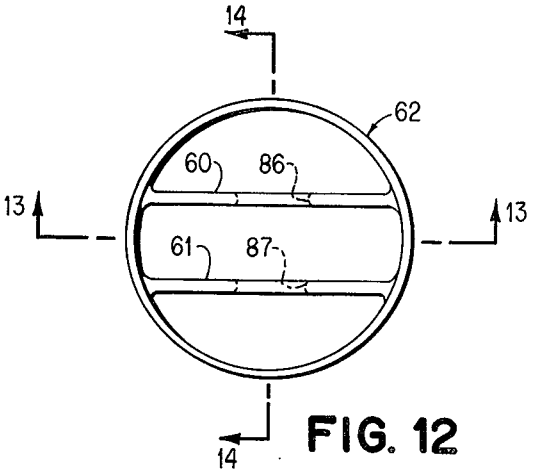
FIG. 12 is a top view of a rotatable, removable insert with a straight top and with bar-separators.

FIG. 12 is a top view of a rotatable, removable insert 62 with a straight top and bar-separators 60 and 61.

Figure 13:
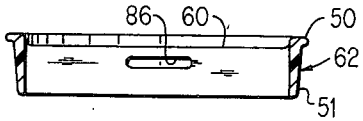
FIG. 13 is a sectional view taken at section 13—13 of FIG. 12.

FIG. 13 is a sectional view taken at section 13—13 of FIG. 12.

Figure 14:
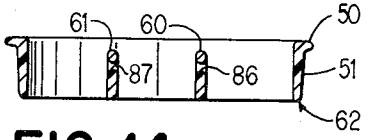
FIG. 14 is a sectional view taken at section 14—14 of FIG. 12.

FIG. 14 is a sectional view taken at section 14—14 of FIG. 12.

The rotatable, removable insert 62 with a straight top and bar-separators 60 and 61 has been previously shown in FIG. 7 and is similar to insert 49 shown in FIG. 4. Insert 62 has bar-separators 60 and 61. Insert 62, like insert 49 in FIG. 4 has a stop 50 and a tapered body 51. Bar-separators 60 has an opening 86. Bar-separators 61 has an opening 87. Openings 86 and 87 can be utilized for gripping purposes in order to remove or rotate insert 62.

Figure 15:
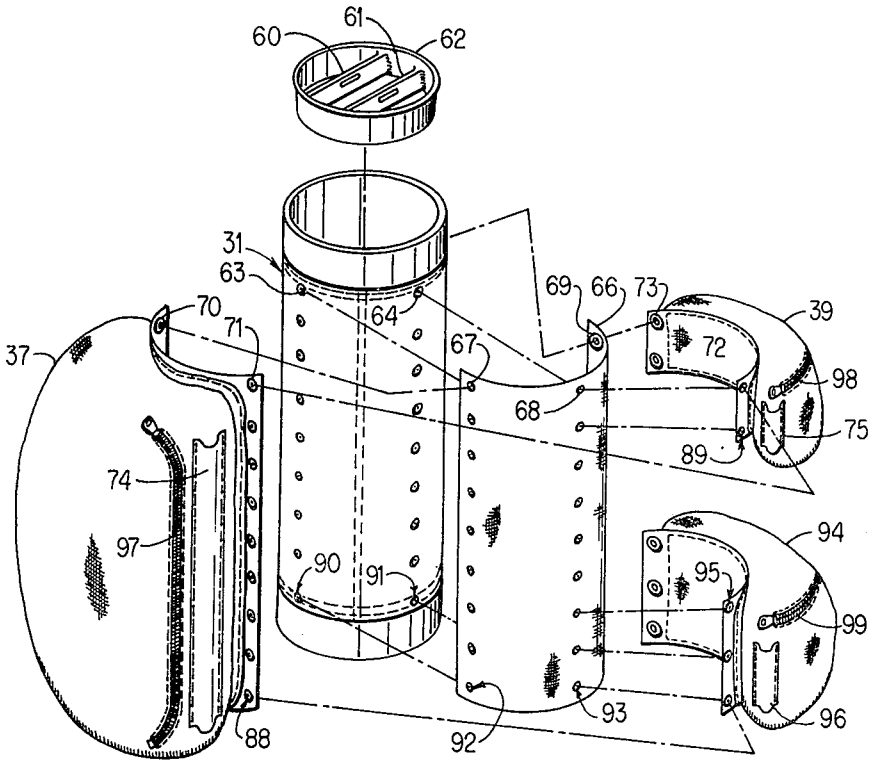
FIG. 15 is an exploded, isometric view of a bag, with exploded straight top insert and with detachable apron, and detachable pockets, with snap fasteners shown.

FIG. 15 is an exploded, isometric view of bag 31 with an exploded top insert 62 and detachable apron 66. Bag 31 has a left series of male snaps 90, the top snap being snap 63. Bag 31 has a center series of male snaps 91, the top snap being snap 64. Bag 31 has a right series of male snaps on bag 31, which is not shown. Snap 65 (not shown) is the top snap on the series of snaps not shown on bag 31 in FIG. 15. Apron 66 has a left series 92 of double snaps, the top snap being snap 67. Apron 66 has a center series 93 of double snaps, the top snap being snap 68. Apron 66 has a right series (not shown) of double snaps, the top snap being snap 69.

Pocket 37 has a series 88 of right double snaps, the top snap being snap 71. Pocket 37 has a series (not shown) of left double snaps, the top snap being snap 70. Pocket 39 has a series 89 of left double snaps and a series of right double snaps such as snap 73. Detachable double pocket 94 has a sleeve 96, a right series of snaps and a left series 95 of snaps. Pocket 37 has a zipper opening 97. Pocket 39 has a zipper opening 98. Pocket 94 has a zipper opening 99. Bag 31 may take the shape desired by the user. If the user desires to utilize apron 66 and pockets 37, 39, and 94, the bag may be connected together as in FIG. 15. Any other combination of pockets desired may be utilized. In FIG. 15, apron 66 is secured to bag 31 by securing the left series of double snaps 92 on apron 66 to the left series male snaps 90 on bag 31. The center series 93 of double snaps on apron 66 is connected to the center series of male snaps 91 on bag 31. The right (not shown) series of double snaps on apron 66, the top snap of which is snap 69 is connected to the right series (not shown) of male snaps on bag 31 the top of which is snap 65. Pocket 37 may be secured to bag 31 by attaching pocket 37 to apron 66. The left series (not shown) of double snaps, the top snap being snap 70 on pocket 37 is secured to the left series of double snaps on apron 66. The right series 88 of double snaps on pocket 37 is secured to the center series 93 of double snaps on apron 66. To secure pocket 39 onto apron 66, the left series 89 of double snaps is connected to an appropriate number of snaps in the center series 93 of double snaps on apron 66. The series of right side snaps, such as top snap 73, on pocket 39 is secured to an appropriate number of snaps in the right series (not shown) of double snaps on apron 66. Snap 73 will be secured to snap 69. Detachable pocket 94 is secured to apron 66 by attaching the left series 95 of snaps to the appropriate number of snaps in center series 93 of double snaps on apron 66. The right series of snaps on pocket 94 is attached to the appropriate number of snaps on the right series (not shown) of double snaps on apron 66. Any desired configuration of pockets can be utilized by securing the desired pocket to the appropriate number of snaps on the apron 66. All of the pockets will be in position to be utilized at all times.

Figure 16:
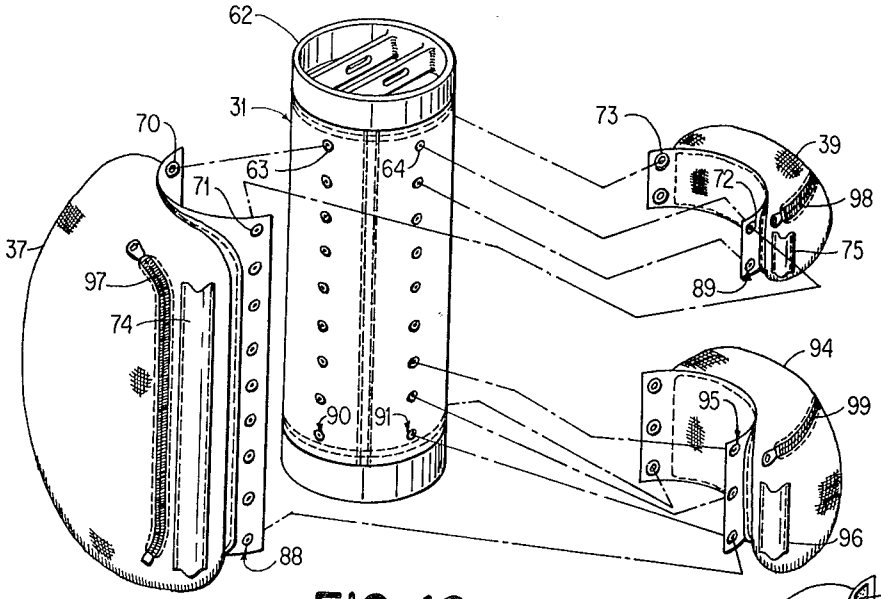
FIG. 16 is an exploded, isometric view of the bag in FIG. 15 without the detachable apron.

FIG. 16 is an exploded, isometric view of the bag is FIG. 15 without the detachable apron 66. The pockets will be attached in a similar manner as in FIG. 15 except that instead of securing the snaps on the pockets to snaps on the apron, the snaps on the pockets will be secured directly to the snaps on bag 31. For example, the series (not shown) of right snaps on pocket 37, top snap being snap 70 is connected directly to the left series 90 of male snaps on bag 31. The series 88 of right double snaps on pocket 37 is connected directly to the center series 91 of male snaps on bag 31. The left series 89 of double snaps on pocket 39 is secured directly to the appropriate number of center snaps on center series 91 on bag 31. The left series 95 of snaps on pocket 94 is secured to the appropriate number of snaps on center series 91 on bag 31. The right series of snaps, such as top snap 73, on pocket 39 and the right series of snaps on pocket 94 are secured to the right series (not shown) of male snaps on bag 31. The series of snaps that are secured to the center series 91 on bag 31 as in FIG. 16 or to the center series 93 on apron 66 as in FIG. 15 may be stacked if desired. The snaps on one pocket may be secured over the snaps on another pocket which is to be secured to the same snap or series of snaps in the center series of snaps on the bag 31 or apron 66.

Figure 17:
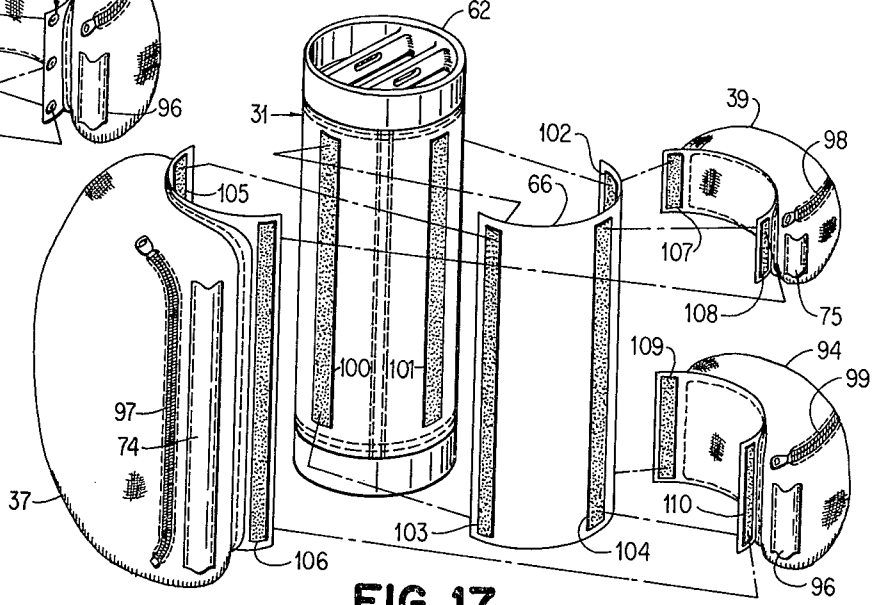
FIG. 17 is an exploded, isometric view of a bag, such as in FIG. 15, with a detachable apron and detachable pockets replacing the various series of snaps with velcro strips as the attachment means.

FIG. 17 is an exploded, isometric view of bag 31 with a detachable apron 66 and detachable pockets utilizing velcro strips to replace the various series of snaps as the attachment means. Bag 31 is shown with left velcro strip 100, center velcro strip 101, and a right velcro strip (not shown). Apron 66 would have a velcro strip (not shown) on the interior left and a velcro strip 103 on the exterior left. Apron 66 would have a velcro strip (not shown) on the interior center and a velcro strip 104 on the exterior center. Apron 66 would have a velcro strip 102 on the interior right and a velcro strip (not shown) on the exterior right. FIG. 17 shows detachable pockets 37, 39 and 94. Detachable pocket 37 would have a velcro strip 105 on the interior left side and a velcro strip (not shown) on the exterior left side. Pocket 37 would have a velcro strip (not shown) on the interior right side and a velcro strip 106 on the exterior right side. Pocket 39 would have a velcro strip (not shown) on the interior left side and a velcro strip 108 on the exterior left side. Pocket 39 would have a velcro strip 107 on the interior right side and a velcro strip (not shown) on the exterior right side. Pocket 94 would have a velcro strip (not shown) on the interior right side and a velcro strip 110 on the exterior left side. Pocket 94 would have a velcro strip 109 on the interior right side and a velcro strip (not shown) on the exterior right side. To secure pockets 37, 39, and 94 to bag 31, apron 66 may or may not be used. If apron 66 is used, the bag may be secured as shown in FIG. 17. The velcro strip (not shown) on the interior of apron 66 would secure to velcro strip 100 on bag 31. The center velcro strip (not shown) on the interior of apron 66 would secure to velcro strip 101 on the center of bag 31. The velcro strip 102 on the interior right of apron 66 would secure to the velcro strip on the right side of bag 31 which is not shown. Velcro strip 105 on pocket 37 would secure to velcro strip 103. Velcro strip (not shown) on the interior right of pocket 37 would secure to velcro strip 104. The velcro strip 107 on the right interior of pocket 39 and the velcro strip 109 on the right interior of pocket 94 would secure to the exterior right velcro strip (not shown) on apron 66. The interior left velcro strip (not shown) on pocket 39 and the interior left velcro strip (not shown) of pocket 94 would secure to velcro strip 104. The left velcro strips of pockets 39 and 94 may be secured either over or under the right side velcro strips of pocket 37 and vice versa. If the apron 66 is not utilized, the pockets may be secured directly to the velcro strips on the bag 31.

The present invention shows a unique golf bag. The golf bag has pockets arranged so that the pockets are easily convenient to the user. The standard golf bag, when mounted on a cart, poses problems in reaching some of the pockets because they are located completely around the main bag. The present bag is designed for mounting on any cart. The bag can be placed in any position for proper club arrangement that is desired. The pockets are all mounted on the bag in a position where all of the pockets and their entry zippers are accessable. If the golfer wishes to lighten the bag for carrying purposes, pockets can be removed to suit the final desired configuration. Various types of rotatable, removable inserts may be utilized to provide desired club storage arrangement. A sloped rotatable, removable insert 56 is shown in FIGS. 9, 10, and 11. A rotatable, removable insert 62 with a straight top is shown in FIGS. 12, 13, and 14. The top might also be tapered or any other desired configuration. The utilization of apron 66 and the various detachable pockets allows the golfer to construct or fabricate a bag to his personal taste. The golfer may also change the configuration of his bag to suit changing circumstances or conditions.

The present invention provides the golfer with one bag which can be utilized in any situation. The bag can be carried, the bag is suitable for use with a powered or hand cart and can be altered to suit a new situation quickly and without special tools.

The present invention, the bag, provides free and unobstructed access to all pockets of the bag regardless of the configuration or where it is mounted. A retail store or pro shop would only have to stock the basic bags and an assortment of aprons and pockets. The golfer can purchase aprons and pockets as desired to suit his purposes.

The attachment means may be any desired attachment means including snaps, velcro strips, zippers, clips, hooks, or any other fastening device. If desired, the pockets can be permanently secured by any desired means, such as the stitching shown in FIG. 1. The long pocket 37 can be secured on either the right or left side of the securing area of the bag. The smaller pockets can be secured on either the left or right side of the securing area of the bag. Any combination of pockets of various sizes which can physically fit into the securing area can be utilized. When utilizing a series of fasteners, such as a series of snaps, the fasteners would be placed equidistant from each other in a line at the fastening points, so that the various pockets can be secured at various positions. Larger pockets would have more connecting fasteners or snaps. If velcro is utilized, the larger pockets would have a larger area which could be secured by the velcro. The fastening area for the apron and pockets is limited to an area not extending over 180° (one hundred eighty degrees) as shown in the present invention. The left and center fastening points are separated by 90° (ninety degrees). The center and right fastening points are separated by 90° (ninety degrees). More or less than 180° (one hundred eighty degrees) may be utilized. More or less than 90° (ninety degrees) between fastening points may be utilized, but in all cases, the fastening points must be such that any desired configuration secured between fastening points would allow easy accessability to all pockets at all times. The sleeves on the pockets, such as sleeve 74 on pocket 37, sleeve 75 on pocket 39, and sleeve 96 on pocket 94, can be utilized to hold umbrellas, retreivers, or any other desired items. Any desired configuration may be utilized to hold the clubs themselves. FIG. 9 shows a configuration with a plurality of openings for the clubs. FIG. 12 shows an opening with just bars to separate the clubs. Any desired method may be utilized. Individual tube club holders may be utilized. Any desired method would come within the scope of this invention.

The present invention solves the problem of acquiring access to all of the pockets. If the pockets can not be reached, irons and woods tend to be banged together with the possibility of damage to the woods. FIG. 2 shows the top insert in the bag which is secured in a hand cart, rotated in a manner so that the woods and pockets would be on the same side of the bag. This configuration is not desirable as shown in FIG. 3 for a powered cart. In a powered cart, it is more convenient for the woods to be on the opposite side from the pockets. In the present invention, the removable, rotatable top insert allows an easy adjustment to protect the golf clubs and to reach the desired configuration. In a powered cart, the bag insert can be rotated to position the woods toward the front of the cart and the pockets to the rear of the cart for easy access. If a hand cart is used, the insert can be located to position the woods on the same side as the pockets for best utilization. If the golfer desires to carry his bag, the pockets can be easily removed to lighten the load. The golfer can buy as little or as much bag as he desires. He doesn't have to have several bags to suit certain situations. If he desires to have additional pocket capacity, only an additional pocket would need to be purchased. If the golfer elected to carry the bag, the insert can be positioned to place the woods on the same side as a shoulder strap, with the pockets mounted on the opposite side to the strap.

The present invention comprises a unique golf bag arrangement, a unique method of removable and attachable pockets on the golf bag and a unique removable and rotatable top insert for the golf bag.

FIG. 17 and other figures show the utilization of an apron on bag 31. The apron may be utilized if desired or not utilized. The apron provides aesthetic value and provides strength and utility for the bag. The apron also performs the key function of allowing the golfer to remove all of his configuration of pockets at one time. The golfer may desire to remove all of the pockets in order to carry the bag or for some other purpose. The golfer will not have to remove each pocket individually. The pockets will remain secured to the apron and may be reattached to the bag in the same configuration when the apron is reattached.

The left center and right side snaps on the bag 31 are single snaps, either male or female. The left center and right side snaps on the apron are double snaps which allow the apron to be snapped into the bag and allows a pocket to be snapped on to the apron. The snaps on the pockets may be single or double snaps. For versatility, the snaps would be double snaps so that the pockets could be moved from one side of the bag to the other side of the fastening area. The apron and the pockets are snapped on to an area of the bag which is a fastening area. The other area of the bag is the mounting area which is utilized for mounting the bag on a cart, either hand or powered, or against the body of the carrier.

The top insert may actually be considered to be a separate invention. The top insert, as shown, may be utilized with any present golf bag for the purposes herein discussed.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for insertion into the top of a bag for carrying golf equipment comprising:

(a) a longitudinally-tapered body with an insert top in the shape of the perimeter of said top of said bag and operative to fit into said top of said bag;

(b) a stop which is rigidly secured to said insert top of said longitudinally-tapered body operative to rest on said bag and to hold said tapered body securely; and (c) gripping means within said device operative to aid in movement of said device;

whereby said device can be removed and rotated by use of said gripping means.

2. A device according to claim 1 further comprising a bar-separator comprising a member with two opposite ends secured in said longitudinally-tapered body whereby said bar-separator is operative to separate said golf equipment contained in said bag.

3. A device according to claim 2 further comprising an opening within said bar-separator operative to be utilized as a gripping means.

4. A device according to claim 3 wherein the height of said insert top is level across said device.

5. A device according to claim 3 wherein the height of said insert top is slanted across said device.

6. A device according to claim 3 wherein the height of said insert top is sloped across said device.

7. A device according to claim 1 wherein said insert top of said longitudinally-tapered body is circular.

8. A device according to claim 1 further comprising a tube-opening sheet secured across said device at the bottom of said longitudinally-tapered body.

9. A device according to claim 8 further comprising a bar secured to the top of said tube-opening sheet with two opposite ends secured in said longitudinally-tapered body.

10. A device according to claim 9 further comprising an opening within said bar operative to be utilized as a gripping means.

11. A device according to claim 8 further comprising a plurality of bars secured to the top of said tube-opening sheet each of said plurality of bars having two opposite ends secured in said longitudinally-tapered body.

12. A device according to claim 11 further comprising an opening within each of said plurality of bars operative to be utilized as a gripping means.

13. A device according to claim 12 further comprising a plurality of tube openings in said tube-opening sheet through which said golf equipment may be placed to be secured within said bag.

14. A device according to claim 13 further comprising a plurality of utility openings in said tube-opening sheet through which said golf equipment may be placed to be secured within said bag.

15. A device according to claim 1 further comprising a plurality of bar-separators each bar-separator comprising a member with two opposite ends secured in said longitudinally-tapered body whereby said each bar-separator is operative to separate said golf equipment contained in said bag.

16. A device according to claim 15 further comprising an opening within each of said bar-separators operative to be utilized as a gripping means.

* * * * *